US008336482B2

(12) United States Patent
Folk et al.

(10) Patent No.: US 8,336,482 B2
(45) Date of Patent: Dec. 25, 2012

(54) FIBER SIZING APPLICATOR

(75) Inventors: Michael David Folk, Oregon, OH (US); Russell Donovan Arterburn, Athens, TN (US); Nicole Anne Curtis, Denver, CO (US); Derek Cooper Bristol, Littleton, CO (US); Dennis J Scherger, Whitehouse, OH (US); Douglas J Kempski, Holland, OH (US)

(73) Assignee: Johns Manville, Denver, CO (US)

( * ) Notice: Subject to any disclaimer, the term of this patent is extended or adjusted under 35 U.S.C. 154(b) by 361 days.

(21) Appl. No.: 12/869,137

(22) Filed: Aug. 26, 2010

(65) Prior Publication Data

US 2010/0319616 A1 Dec. 23, 2010

Related U.S. Application Data

(62) Division of application No. 11/449,212, filed on Jun. 8, 2006, now Pat. No. 7,803,429.

(51) Int. Cl.
*B05C 11/02* (2006.01)
*B05C 11/04* (2006.01)

(52) U.S. Cl. ..... 118/104; 118/203; 118/234; 118/244; 118/261; 118/413; 118/420

(58) Field of Classification Search ..... 118/234, 118/420, 33, 104, 204, 122, 203, 244, 246, 118/257, 261, 603, 413; 427/345, 355, 160, 427/211, 384, 386
See application file for complete search history.

(56) References Cited

U.S. PATENT DOCUMENTS

| | | | | |
|---|---|---|---|---|
| 3,067,719 | A * | 12/1962 | Banks | 118/257 |
| 4,381,199 | A * | 4/1983 | Graham | 162/156 |
| 5,349,716 | A * | 9/1994 | Millar | 15/245 |
| 6,779,365 | B2 * | 8/2004 | Wilkins et al. | 65/430 |
| 2005/0066688 | A1 * | 3/2005 | Eis et al. | 65/381 |

* cited by examiner

*Primary Examiner* — Nathan Empie
*Assistant Examiner* — Alexander Weddle
(74) *Attorney, Agent, or Firm* — Robert D. Touslee

(57) ABSTRACT

Disclosed are fiber coating sizing applicator apparatus having a member to remove unused sizing and foreign objects from the fiber coating element of the applicator on a continuous or intermittent basis. Also disclosed are sizing applicators having as part of the drive, a servo motor for reduced variation in sizing application. Unused sizing is filtered to remove foreign objects and returned the applicator right away, or stored in a temperature controlled area until ready to feed back to a sizing applicator. Also disclosed are methods of using the sizing applicator apparatus to produce sized fibers. The apparatus and methods of the invention produce a substantial reduction in the fiber break rate, sizing usage and applicator maintenance.

19 Claims, 7 Drawing Sheets

FIBER SIZING APPLICATOR

This application is a division of application Serial No. 11/449,212, now U.S. Pat. No. 7,803,429, filed Jun. 8, 2006. The invention involves apparatus for applying a protective liquid sizing to the surface of rapidly moving fibers and a method for making sized fiber using this apparatus. The invention produces a more uniform sized product, reduces breakout rate of the fiberizing bushings, reduces costly sizing waste and reduces applicator maintenance, resulting in better fiber products and significantly reduced manufacturing costs.

BACKGROUND

In the manufacture of mineral fiber from molten material, it has been common practice to apply a liquid size to the fiber as the fiber moves rapidly, at least 1000 feet per minute and usually much faster from the fiberizing bushing towards a turning or pad wheel. The liquid sizing, that can be any one of many available to tailor the fiber for particular applications, usually contains one or more film formers to protect the fiber and hold the sizing together, one or more lubricants to protect the fiber from abrasion and to reduce friction and one or more linking agents that promote bonds between the surface of the fiber and the film former and/or the matrix or binder that will surround the fiber at a later time in any one of thousands of applications. Many applicators are known for applying sizing such as those disclosed in U.S. Pat. Nos. 6,592,666, 6,818,065.

Prior art applicators have one or more shortcomings that the present invention addresses. One shortcoming is that of maintaining a reservoir of sizing in a lower portion of the applicator. The temperature in the forming room is often above room temperature and the sizing applicators are exposed to radiant heat from the red-yellow hot bushings. This causes sizing that sets in a reservoir for various lengths of time to degrade and to form higher viscosity and/or globules. Also, dust, foreign particles and pieces of fiber often come in contact with the element of the applicator that contacts the fiber that is being sized. These dust and fiber particles and segments then get washed off into the sizing that is in the reservoir and is then reapplied to the applicator element, such as a roll or a belt. The presence of high viscosity sizing, globules of sizing, foreign particles and pieces and/or segments of fiber on then fiber contacting element of the applicator cause fiber breaks, incomplete sizing of the fiber and undesirable sizing content variation in the finished fiber product. These problems with prior sizing applicators have been made worse, more frequent and more costly, as more fibers are pulled from a bushing necessitating that the applicator be larger, wider to accommodate the wider fan or array of fibers thus making it easier for foreign matter to collect on the applicator element and get into the sizing and providing more surface area for radiant heating from the bushings. Bushings today typically produce 3000 or more fibers and often produce 4000-7,000-8000 fibers, particularly when making chopped fiber products.

The above conditions pertain to the sizing of fibers made from any molten material and are most costly in the manufacture of so-called "continuous" glass fiber products made from molten glass. In the manufacture of continuous glass fibers, melting furnaces are typically used to melt batch, refine the molten glass, and to feed molten glass through one or more forehearths and usually a plurality of bushing legs to the bushings. The bushings are maintained at a temperature that is in the red to yellow heat range for glass. Typically hundreds to thousands of fibers are pulled at speeds up to more than 100 miles per hour from molten beads, meniscus, of glass that form at the end of each hollow nozzle or orifice on the bottom of the bushing. The fibers are rapidly cooled and in fractions of a second are brought into contact with the fiber coating element (element of the applicator that carries the sizing to the fiber) of the applicator, usually a curved surface, a roller or a belt. A layer of sizing exists on the surface of the coating element of the applicator, continuous layer when working properly, but often discontinuous due to conditions mentioned above. The rapidly moving fiber is in contact with the element and layer of sizing for only microseconds and if a portion of the element is not coated with sizing the fiber coming in contact with that portion will either break, not get coated with sizing or not receive enough sizing.

When one or more fiber choppers are present in the fiber forming room, which is normal due to the large amount of chopped fiber produced to make nonwoven mats and other chopped fiber products, the amount of fiber particles, backup roll particles, and fiber segments in the air is greatly increased.

When a fiber breaks, all of the fibers coming from the same bushing soon break out. Many seconds are then required for the bushing to "bead out" and to be producing primary, coarse fibers from each nozzle. At that time the bushing can be restarted by the operator or a machine taking all or most of the primary fibers to the chopper and inserting them into the chopper. If the operator is busy with another task, the bushing continues to be out of production until the operator is able to restart the bushing. The longer the bushing is "hanging", the more the system deviates from optimum fiberizing conditions and this causes further fiber breaks, with the "hanging bushing" and bushings downstream in a same bushing leg. It is well established that the higher the rate of fiber breaks of a bushing, a leg of bushings and of an entire forming room, the greater the variation of the fiber diameter and the LOI, sizing content, of the fiber products being produced.

The present invention addresses these shortcomings of prior art sizing applicators to reduce fiber break rate, reduce manufacturing costs, and to improve both productivity and product quality.

SUMMARY

It has been discovered that if filtered sizing liquid is applied over a working surface of a fiber coating, size applying, element of the applicator with a size distributor and then the element is cleaned continuously or at least intermittently with a device that will remove all or most of the sizing and foreign items including globules of sizing material, particles, segments or pieces of fiber or fibers, from the working surface of the element, and the removed sizing and foreign materials are removed to a cooler area, and/or filtered before being returned to the applicator, the problems discussed above with prior art applicators are avoided or greatly reduced. The element is a curved surface, roll or belt that carries a layer of sizing to a plurality of fibers that are rapidly passing very close or kissing the working surface of the element thereby causing the fibers to contact the layer of sizing and to become coated with the sizing.

The removed unused sizing and foreign objects are normally collected in a return line that returns this material, optionally after filtering, to a sizing holding tank in a location not subject to radiant heating from one or more bushings and most typically in a controlled temperature environment. Alternatively, the removed sizing and foreign objects can be filtered immediately and immediately refed to the applicator distributor along with a stream of fresh, make-up, sizing. Also alternatively, the unused sizing and foreign objects can be discarded or used for another purpose. In the latter case filtering of the unused sizing is usually not required, but it is most typical to still filter the fresh sizing before it is fed to the distributor.

The sizing applicator of the invention comprises a sizing distributor, a fiber coating element having a movable, working curved surface, a mechanism to cause the working, curved surface to move and a device for cleaning the fiber coating element at a location downstream of the fiber coating location. The device for cleaning is most typically in continuous contact with the working curved surface, but optionally can be in intermittent contact in which case the applicator would also comprise a mechanism for intermittently moving the device for cleaning into and out of contact with the working, curved surface. Applicators of the invention do not have a resevoir for sizing and for the applicator coating element, like a roll or belt, to move through to pick up sizing.

The invention also includes a method of using the applicator to coat an array of fibers with sizing, the method including removing the unused sizing containing foreign objects from the applicator coating element or continuously, removing the unused sizing containing foreign objects from the area of radiant convection heating by the fiberizing bushings, and filtering the unused sizing to remove the foreign objects before returning the unused sizing, with or without fresh sizing, to the applicator. It is also possible to intermittently remove unused sizing from the funnel at the bottom of the applicator and filter it to remove the foreign objects before returning it to the applicator. By intermittent is meant accumulating the sizing in the applicator for no longer than about 5 minutes, more typically no longer than about 2 minutes and most typically no longer than up to about 0.25 to 1 minute before draining the sizing and filtering it before recycling the unused sizing back to the applicator. Most typically the unused sizing is drained from the applicator and funnel continuously, filtered and returned to the applicator or to a holding tank that is in a cool area or is kept cool.

When the word "about" is used herein it is meant that the amount or condition it modifies can vary some beyond that stated so long as the advantages of the invention are realized. Practically, there is rarely the time or resources available to very precisely determine the limits of all the parameters of ones invention because to do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept, the objectives of the invention and embodiments disclosed, including the best mode known to the inventor, the inventor and others can, without inventive effort, explore beyond the limits disclosed using only ordinary skill to determine if the invention is realized beyond those limits, and when embodiments are found to be without any unexpected characteristics, those embodiments are within the meaning of the term about as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION

Figure 1:
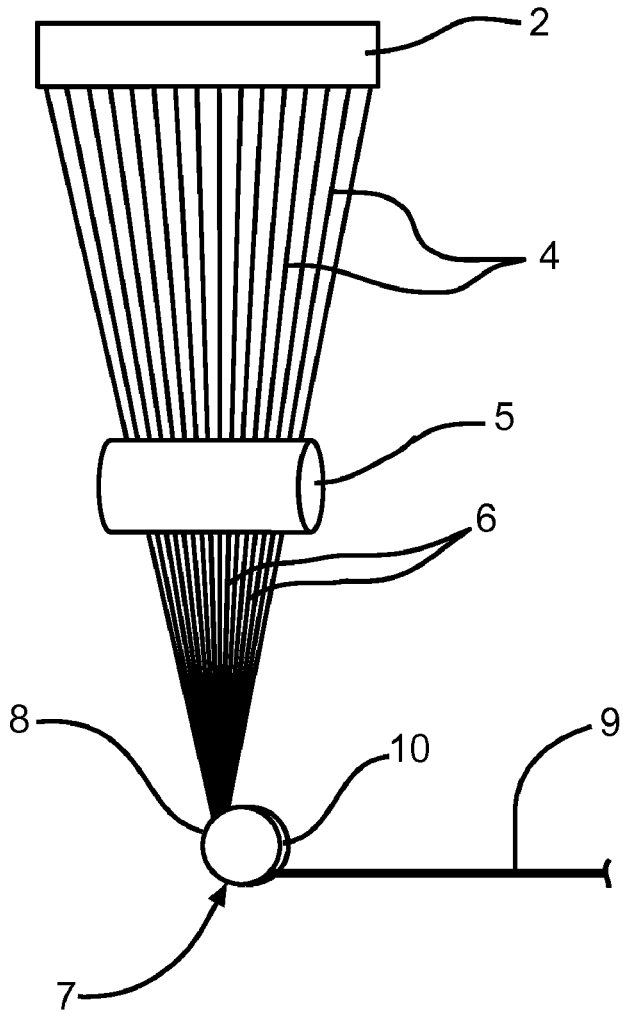
FIG. 1 Prior Art
FIG. 1 is a partial view of a typical bushing position in a forming room showing the applicator of the invention.

FIG. 1 shows a typical fiberizing position in a fiber forming room comprising a fiberizing bushing 2 for converting molten material into fibers 4, with the sizing applicator 5 of the invention producing more uniformly coated sized fibers 6 that are then fed to a winder of known types, or as shown here, is turned with a rotating pad wheel 7 comprised of a stationary or rotatable wheel 8 having a groove 10 in its outer periphery that gathers the array of sized fibers 6 into a fiber strand 9 that can is typically pulled by a conventional fiber chopper (not shown). The bushing 2 typically has nozzles or hollow tips on the bottom side through which the molten material flows in a known manner to form the fibers 4. The molten material forming the fibers is typically very hot, over 2000 degrees F. when the molten material is molten glass. The sizing applicator 5 is located in the same or similar positions with respect to the bushing 2 and adjoining bushings (not shown) as prior art applicators, which is typically in the range of about 4 to about 8 feet from the bottom of the fiberizing bushing. At this distance, the hot bushing 2, particularly the radiant and convective heat from the bushing 2 and hot glass exiting the bushing 2, can cause the temperature of at least portions of the applicator to rise and operate at a temperature significantly above the temperature of the forming room and particularly of the sizing being delivered to the applicator 5.

Figure 2:
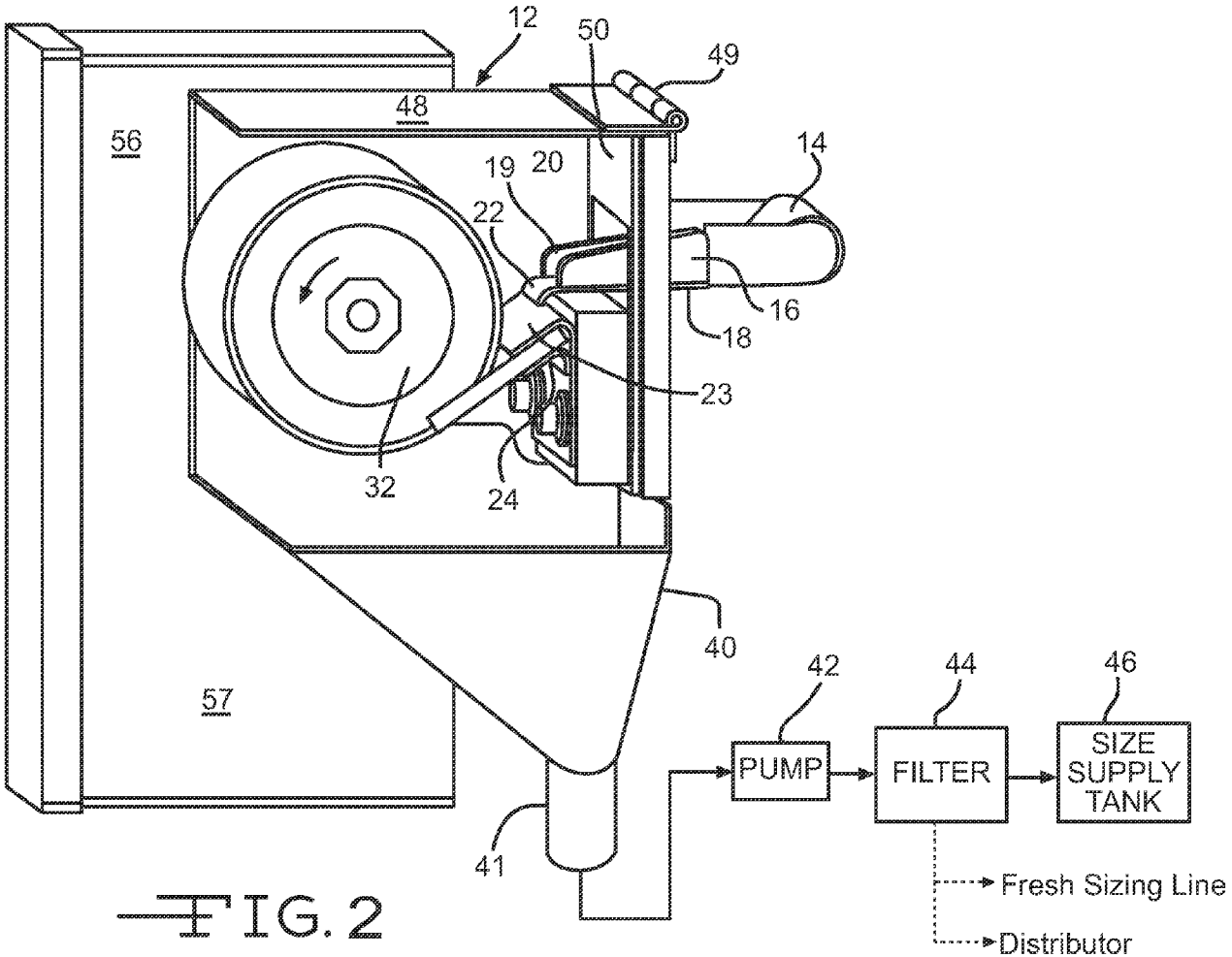
FIG. 2 is a perspective view of one applicator embodiment of the invention, the view taken from one end of the applicator with part of the cover removed to better show interior parts.
Figure 3:
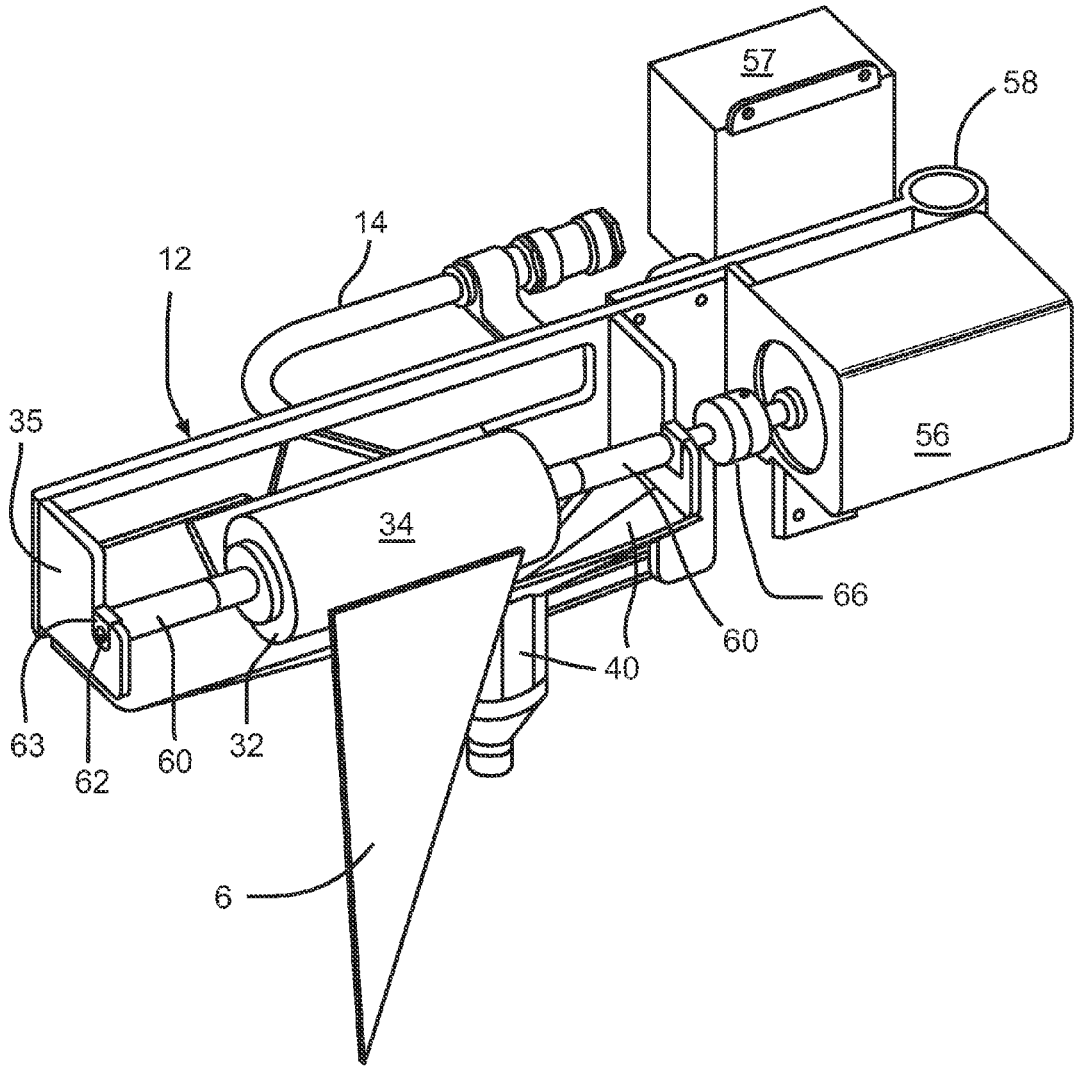
FIG. 3 is a perspective view of the embodiment shown in FIG. 2, taken from in front of the applicator and shown with the top cover removed to see the interior of the applicator.
Figure 4:
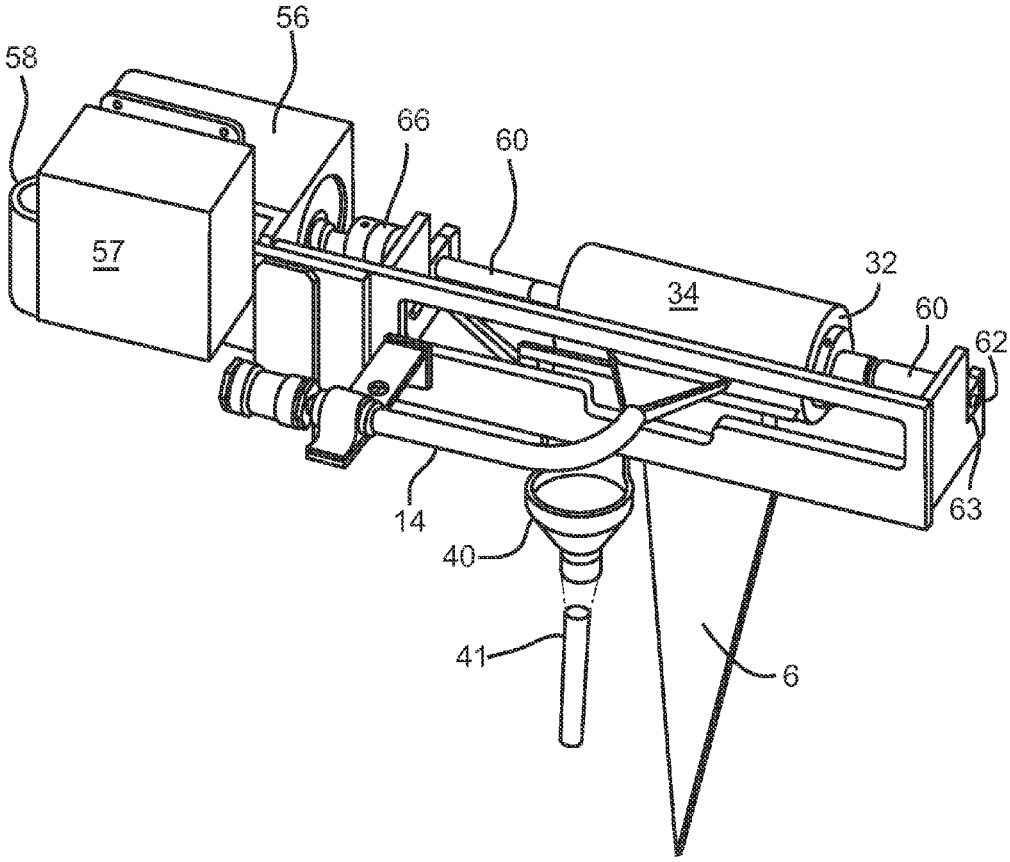
FIG. 4 a perspective view of the embodiment shown in FIGS. 2 and 3, but taken from the back of the applicator and shown with the top cover removed to see the interior of the applicator.

FIGS. 2-4 illustrate an embodiment 12 of the sizing applicator of the invention, with various parts of the enclosing cover removed to better show the interior of the applicator 12. The sizing enters the applicator 12 through a sizing supply line 14 at a controlled rate and flows onto or into a sizing distributor 16 that, in this embodiment is fan shaped to cause the sizing to spread out to form a thin, continuous layer of sizing on a bottom plate 18 of the distributor 16. The distributor has two sidewalls 19,20 to contain the sizing as it flows in a thin layer through the distributor 16. In this embodiment 12, the bottom plate 18 has a curved lip 22 at its the exit to direct the thin flowing layer of sizing onto a top of an upper holding member 23 for a doctor blade 26. The doctor blade 26 is held in place with the upper holding member 23 and a lower holding member 24 that is biased sufficiently against the upper holding member 23 that sufficient pressure is exerted on the doctor blade 26 to hold the latter in place during operation. The bottom plate 18 of the distributor 16 and the upper holding member 23 are either made from a material that is readily wet with the sizing compositions, or is coated on the size contacting surface(s) with a material that is readily wet with the sizing compositions so the sizing will readily form a continuous layer of sizing on the size contacting surfaces.

Figure 5:
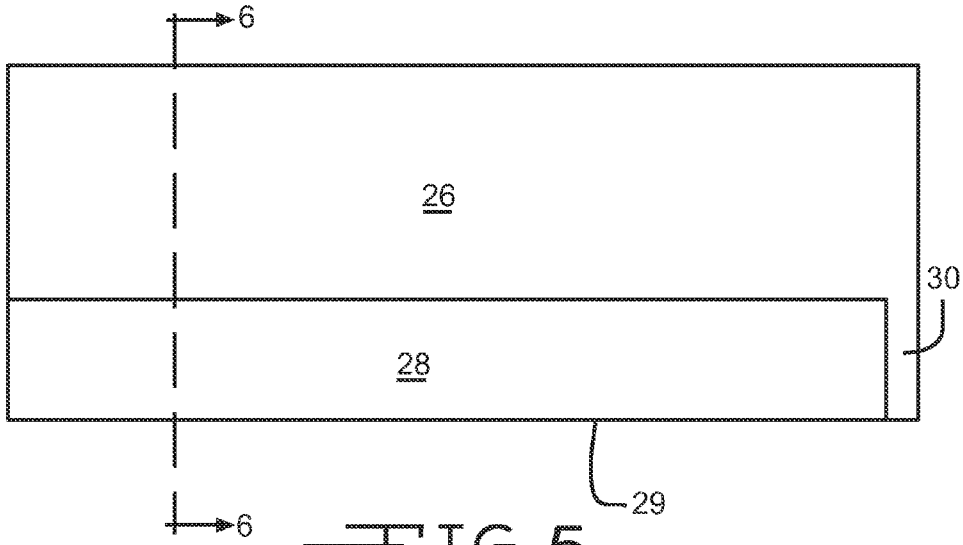
FIG. 5 is a plan view of a doctor blade used in the invention.
Figure 6:
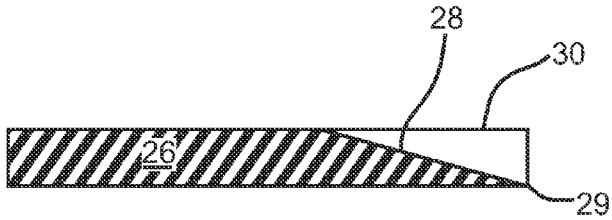
FIG. 6 is a cross sectional view of the doctor blade shown in FIG. 5 taken along lines 6-6.

The doctor blade 26 used in embodiment 12 is shown in detail in FIGS. 5 and 6. FIG. 5 is a plan view of the doctor blade 26 showing a tapered region 28 extending for all, or in this embodiment 12, most of the width of the doctor blade 26, tapering from the full thickness of the doctor blade 26 to a sharp edge 29. The taper can be on either an upper surface of the doctor blade 26 or on its lower surface. In FIGS. 2 and 5-7, the tapered region 28 is on the upper surface of the doctor blade 26. A short, optional, side wall 30 is formed on one end of the doctor blade 26 by the tapered region 28, the short sidewall 30 preventing the doctor blade 26 from moving laterally out of position during operation. Another member of the applicator 12, such as the end cover that has been removed to better see the interior, or another member, can be located close to the exterior of the sidewall 30 to further prevent the doctor blade from moving out of the desired position. The sharp edge 29 of the doctor blade 26 lays against (in contact with), or very close (near contact with) a peripheral surface of a fiber coating element or roll 32, the peripheral surface being the working surface 34, i.e. close enough to the working surface 34 to remove the foreign objects that are on the working surface 34. The sharp edge 29 of the doctor blade 26 should be no further than 0.03 inch, more typically no further than 0.02 inch, from the working surface 34 and most typically is in contact with the working surface 34, or near contact at closer than 0.015 inch. Any shape and any material conventionally used as a working surface on conventional fiber coating elements of conventional sizing applicators can be used to make the working surface of 34 in the invention. Most typically, carbon or graphite is used to make the working surface 34 of the embodiment shown in FIGS. 2-7.

The sharp edge 29 of the doctor blade 26 most typically extends the entire length of the fiber-coating element 32, but need not do so. It is only necessary that the sharp edge 29 exist in the fiber contacting zones of the working surface 34, but to ensure that all foreign material is removed from the working surface 34, it is best that the sharp edge 29 extend, uninterrupted, along the entire length of the element 32.

Figure 2B:
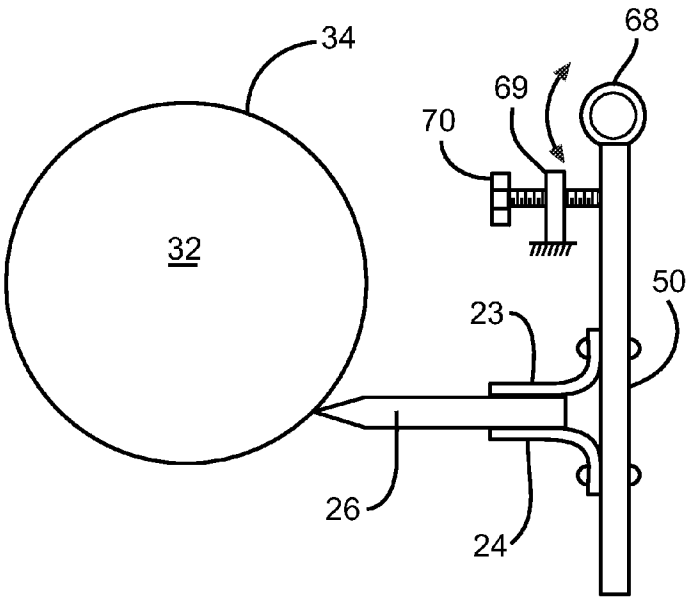
Figure 2A:
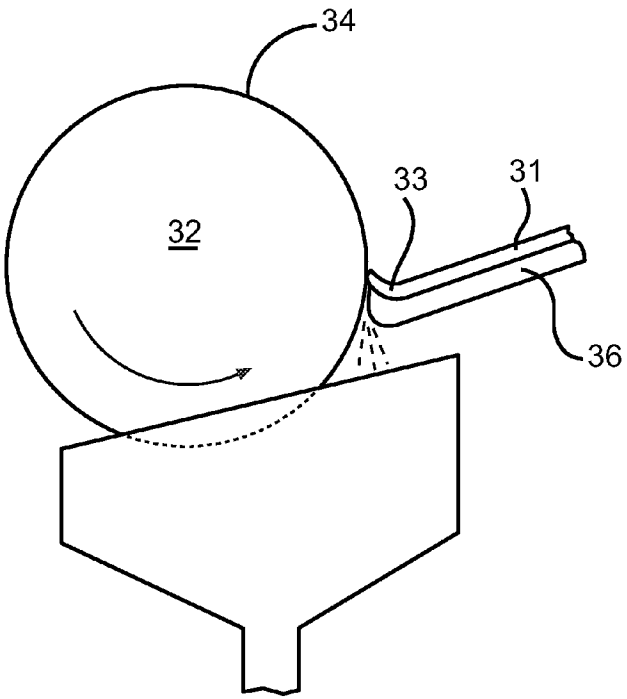
Figure 7:
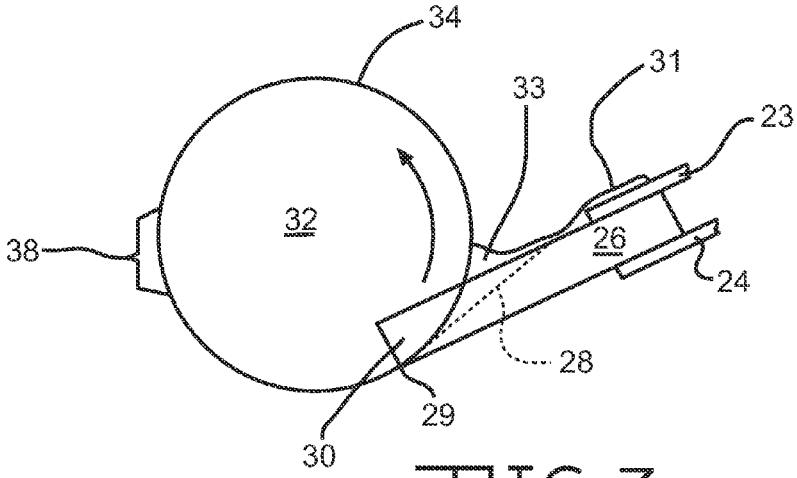
FIG. 7 is a partial end view of the sizing applicator of the invention showing the flow of sizing to a fiber sizing applicator element.

FIG. 7 shows the fiber coating element, roll 32, having the working surface 34 in operation. A layer of sizing 31 is formed by the lip 22 of the distributor 16 and flows down over the top surface of the doctor blade 26 forming a minimal amount of excess to coat the working surface 34, or pool 33, of sizing where the layer of sizing 31 meets the working surface 34. The working surface 34, being one that is readily wet by the sizing composition being used, picks up more than sufficient sizing to properly coat the fibers in the region 36 where the rapidly moving fibers contact or nearly contact the working surface 34. Excess sizing and foreign objects that tend to stay on the working surface 34 are then removed by the doctor blade 26, or the wiper or squeegee 36 (FIG. 2A). While it is most typical to have the sharp edge 29 of the doctor blade 26, or the leading edge of the squeegee 36, in contact, or near contact, with the working surface 34 at all times during operation of the applicator 12, that is not necessary so long as the doctor blade is not out of contact, or out of near contact, with the working surface 34 longer than about 5 minutes, more typically no longer than about 2-3 minutes at a time, and most typically no longer than about 0.5-1 minute. Many ways can be used to achieve intermittent contact or near contact with the working surface 34 such as that shown in FIG. 2B where the back cover 50 is mounted on a shaft 68 that can be rotated back and forth, using any conventional means, to move the sharp edge 29, or leading edge of the squeegee 36 out of position with respect to the working surface 34 and back into position. By having a stop mechanism comprising a support 69 and an adjustable stop bolt 70, the doctor blade 26 can also be controlled to a "near contact" position.

While a doctor blade 26 is shown in the applicator embodiment of FIGS. 2-7, any device capable of wiping the unused sizing and foreign objects from the working surface 34 can be used to replace the doctor blade 26, including a flexible or rigid squeegee 36, see FIG. 2A. Excess sizing and foreign objects removed from the working surface 34 are collected with a basin 40 located below the element 32 in a position to do so and to not interfere with the sized fibers 6 as is well known, and are removed from the basin 40 with a pipe 41. Using gravity or a pump 42, the unused sizing and foreign objects are passed through a filter 44 to remove any foreign object having a dimension greater than about 13 microns, more typically no greater than about 10 microns and most typically no greater than about 8 microns. After filtering the sizing is then sent on to at least one of three practical locations; 1) the size supply tank, (2) injected into a fresh sizing supply line or (3) injected into the distributor 16, or the pipe distributor 17 (see FIGS. 8 and 9) of the applicator of the invention. In any case, the unused sizing, before and after filtering, if it is to be in an area where it is likely to be heated up by radiant and convection heat from the bushings 2, is not contained in that area for more than about 300 seconds, more typically for not more than about 60 seconds and most typically for not more than about 30 seconds. The unused sizing is removed from that area, filtered as described above and put into the size supply tank 46 or other holding tank in a temperature controlled location until it is fed back to the applicators 12. The filtering step can be delayed until the sizing is ready to be sent to the applicators if desired.

Materials for the doctor blade, wiper or squeegee can be any material conventionally used to contact the rapidly moving fibers 4 or sized fibers 6 in conventional sizing applicators, pad wheels or gathering wheels. Typically, the doctor blade is made of urethane or rubber or equivalent material, most typically urethane or live rubber.

The motor 56 for rotating the roll having as its surface working surface 34 can be any type of motor, but most typically is a servo motor. This novel embodiment, using a servo motor on the applicator of the invention, results in a control capability of +/−0.1 RPM, much improved over the prior art applicators using different types of motors on sizing applicators. Reduced variation of the working surface 34 speed results in reduced variation of sizing on the fibers 6, reduced usage of sizing per unit weight of fiber and a lower manufacturing cost.

Figure 8:
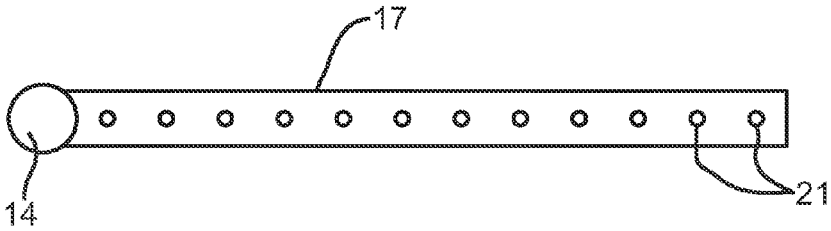
FIG. 8 is a front view of an alternate distributor for use in the invention.
Figure 9:
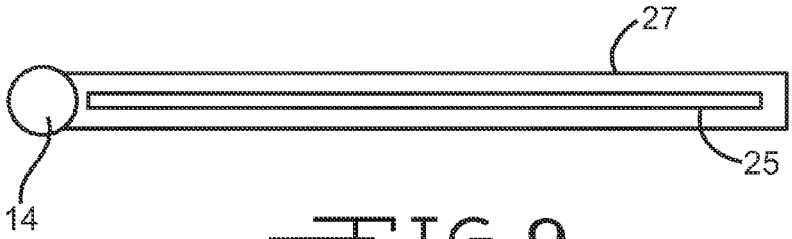
FIG. 9 is a front view of a still further alternate distributor for use in the invention.

Different embodiments employing the concept and teachings of the invention will be apparent and obvious to those of ordinary skill in this art and these embodiments are likewise intended to be within the scope of the claims. For example, the fan shaped sizing distributor 16 can be replaced with any device that will distribute sizing across at least the working width of the fiber coating element of the applicator, such as the pipe distributors shown in FIGS. 8 and 9. The pipe distributor 17 of FIG. 8 extends entirely across or almost entirely across the width of the top holding member 23 of the doctor blade 26, or equivalent device used to remove unused sizing and foreign objects, and has a plurality of spaced apart holes 21 for distributing the sizing across the upper holding member 23 and the doctor blade 26. As shown in FIG. 9, the holes 21 can be replaced with at least one continuous slot 25 or with one or two or more discontinuous slots (not shown).

In the embodiment shown in FIGS. 2-6, the applicator 12 has a hinged cover 48 having a hinge 49 on one end attached to a back cover 50 of the applicator 12, a handle 51 and having two leading ends 53,54 that extend downward on each side of the working surface 34 of the fiber coating element 32. While the fiber coating element 32 in this embodiment is a roll, it can be a belt or any other shape or configuration conventionally used to coat fibers with sizing. The roll 32 is driven, most typically in a direction such that the working surface 34 is moving in the same direction as the fibers 4 when the fibers 4 contact or nearly contact the working surface 34, with a conventional variable speed motor 56, most typically a servo motor, most typically a low voltage motor such as 24 volts for safety purposes. It is conventional to use one controller to control and maintain the speed of several or many sizing applicators so they are all the same. This can be done in the operation of the applicators of the invention, but most typically, a separate controller 57 is used on each applicator 12 to enable tailoring each applicator to the conditions existing with each bushing 2 and each bushing position. Using a servo motor to drive the roll 32, the applicator 12 has a capability to control the RPM of the roll 32 within about 0.1 RPM, much better than the about 3.5 RPM variability encountered with variable speed motor drives in conventional sizing applicators. The applicator is mounted in any conventional manner, such as with a brackets 58 that mounts over a standpipe mounted to the floor of the forming room and enabling the applicator 12 to be rotated around the standpipe to move the applicator 12 into and out of operating position as is conventional.

The fiber sizing element 32, roll 32, is supported on a shaft 60 having on an outboard end a bearing 62, The bearing 62 is most typically supported in a open topped slot 63 in the end plate 35 so that the roll 32 can be quickly removed if damaged and replaced with a new or reconditioned roll 32. To facilitate, the coupling 66 is a spring loaded spline type. Typically the diameter of the roll 32 ranges from about 4 inches to about 1.8 inches inches, as the roll 32 is repeatedly redressed to remove damaged areas.

Figure 10:
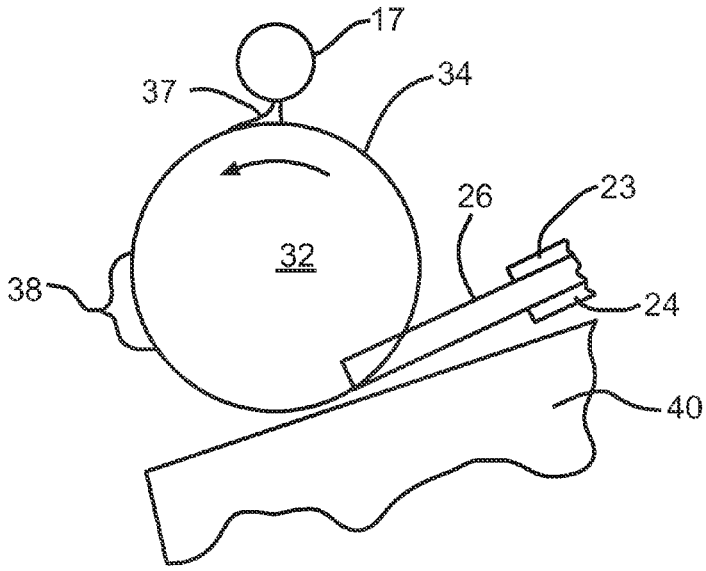
FIG. 10 is a partial end view of the apparatus of the invention in use with the distributors shown in FIGS. 8 and 9.

The excess sizing and foreign objects can be removed at any location after the fiber coating portion of the revolution of the fiber coating element 32 has taken place and most typically this is at a location where the excess sizing and foreign objects will fall by gravity into the collection basin 40, but it will be obvious to those skilled in the art that removal could be achieved, at added difficulty and complexity, at other locations, but with no practical effect. Also, while it is most typical to use the device for removing excess sizing and foreign objects to also provide a new layer of sizing on the working surface 34, it is entirely practical to add the new layer of sizing 37 at a different location, such as closer to the coating region 38 as shown on another embodiment shown in FIG. 10, using one of the distributors 17 or 27 and applying the sizing onto the working surface 34 through any reasonable type of openings including spaced holes 21, a slot 25, a plurality of slots, etc., as shown in FIGS. 8 and 9.

Using the sizing applicator of the invention, the break rate has been reduced about 20 percent versus that of positions making the same product, but using conventional sizing applicators. Other benefits include a substantial reduction in expensive sizing usage, long life of the fiber coating element, more uniform LOI in the fiber product and a reduction in labor needed to clean the working surface of the fiber coating elements of the conventional applicators.

Many other deviations will be obvious to those skilled in the art, given the benefit of the above disclosure, and those deviations are intended to be included within the scope of the following claims. Nor does the inventor intend to abandon or dedicate to others any disclosed inventions that are reasonably disclosed but that do not appear to be literally claimed below, but rather intends those embodiments to be within the scope of the broad claims, either literally or as equivalents to the embodiments that are literally included.

What is claimed is:

1. A sizing applicator apparatus and sizing system for coating rapidly moving fibers moving at a speed of at least 1000 feet per minute with a liquid sizing, in a fiber forming room containing hot fiberizing bushings having a temperature of over 2000 degrees F or more and one or more fiber choppers, the sizing applicator apparatus and sizing system comprising:

a) a fiber coating element having a continuously moving working surface, the applicator being exposed to heat from the hot fiberizing bushings, the applicator having a top cover above, and spaced from the continuously moving working surface and the applicator receiving sizing from a sizing supply tank in the sizing system, b) a filter for filtering the sizing having a capability of removing any foreign material larger than 13 microns prior to the introduction of the sizing onto the moving working surface of the fiber coating element of the sizing applicator, the filter being remote from the fiber forming room in a cooler, temperature controlled, environment, the filter located upstream of the sizing supply tank, c) a distributing element for distributing the filtered sizing across the continuously moving working surface of the fiber coating element, d) a doctor blade or squeegee for removing any unused sizing and foreign objects from the continuously moving working surface, a removing portion of the doctor blade or squeegee located downstream of a location where the continuously moving working surface would contact the fibers for coating, e) a drive for moving the working surface, and f) a basin and pipe for removing unused sizing and foreign items from the sizing applicator and a system transporting the unused sizing and foreign items to the filter.

2. The applicator of claim 1 wherein the drive includes a servo motor.

3. The applicator of claim 1 wherein the member is a doctor blade that is in contact with the working surface.

4. The applicator of claim 1 comprising a doctor blade.

5. The applicator of claim 4 wherein the drive includes a servo motor.

6. The applicator of claim 4 wherein the doctor blade is in contact with the working surface.

7. The applicator of claim 4 wherein the doctor blade is urethane.

8. The applicator of claim 7 wherein the drive includes a servo motor.

9. The applicator of claim 7 wherein the doctor blade is in contact with the working surface.

10. The applicator of claim 4 wherein the doctor blade is rubber.

11. The applicator of claim 10 wherein the drive includes a servo motor.

12. The applicator of claim 10 wherein the doctor blade is in contact with the working surface.

13. The applicator of claim 1 comprising a squeegee.

14. The applicator of claim 13 wherein the squeegee is urethane.

15. The applicator of claim 13 wherein the squeegee is rubber.

16. The applicator of claim 13 wherein the drive includes a servo motor.

17. The applicator of claim 13 wherein the squeegee is in contact with the working surface.

18. A sizing applicator apparatus and sizing system for coating rapidly moving fibers moving at a speed of at least 1000 feet per minute with a liquid sizing, in a fiber forming room containing hot fiberizing bushings having a temperature of over 2000 degrees F and one or more fiber choppers, the sizing applicator apparatus and sizing system comprising:

a) a continuously moving coating element having a continuously moving working surface, the applicator being exposed to heat from the fiberizing bushings, the applicator having a top cover above, and spaced from the continuously moving working surface and the applicator receiving sizing from a sizing supply tank, b) a filter for filtering the sizing having a capability of removing any foreign material larger than 13 microns prior to the introduction of the sizing onto the moving working surface of the fiber coating element of the sizing applicator, the filter being remote from the fiber forming room in a cooler, temperature controlled, environment and the filter located upstream of the sizing supply tank, c) a distributing element for distributing the filtered sizing across the continuously moving working surface of the fiber coating element, d) a doctor blade for removing any unused sizing and foreign objects from the continuously moving working surface, a removing portion of the doctor blade located downstream of a location where the continuously moving working surface would contact the fibers for coating, e) a drive for continuously moving the working surface, the drive comprising a servo motor for significantly reducing the variation in the working surface speed f) a basin and pipe for removing unused sizing and foreign items from the sizing applicator and a system for transporting the unused sizing and foreign items to the filter.

19. The sizing applicator of claim 18 wherein the doctor blade is in contact with the continuously moving working surface.

* * * * *